US011566434B2

(12) United States Patent
Foster, III

(10) Patent No.: US 11,566,434 B2
(45) Date of Patent: Jan. 31, 2023

(54) ENHANCED GLAZING DEVICE, ASSEMBLY AND METHOD FOR OPERATING THE SAME

(71) Applicant: Paul Victor Foster, III, Westminster, CO (US)

(72) Inventor: Paul Victor Foster, III, Westminster, CO (US)

( * ) Notice: Subject to any disclaimer, the term of this patent is extended or adjusted under 35 U.S.C. 154(b) by 247 days.

(21) Appl. No.: 16/907,366

(22) Filed: Jun. 22, 2020

(65) Prior Publication Data

US 2020/0399909 A1 Dec. 24, 2020

Related U.S. Application Data

(60) Provisional application No. 62/865,040, filed on Jun. 21, 2019.

(51) Int. Cl.
*E04F 21/28* (2006.01)
*E06B 3/54* (2006.01)

(52) U.S. Cl.
CPC ..... *E04F 21/28* (2013.01); *E06B 3/54* (2013.01)

(58) Field of Classification Search
CPC ..... E04F 21/28; E04F 21/185; E04F 21/18; E04F 13/0892; E06B 3/54
See application file for complete search history.

(56) References Cited

U.S. PATENT DOCUMENTS

| | | | | |
|---|---|---|---|---|
| 4,571,902 | A * | 2/1986 | Liebetrau | E04F 21/28 52/DIG. 1 |
| 5,675,942 | A * | 10/1997 | Crawford | E04F 21/18 52/509 |
| 7,621,100 | B2 * | 11/2009 | Kufner | E04F 21/185 52/749.11 |
| 9,683,363 | B2 * | 6/2017 | Pearson | G10K 11/16 |
| 2006/0185269 | A1 * | 8/2006 | Kufner | E04F 21/22 52/169.1 |
| 2020/0399909 | A1 * | 12/2020 | Foster, III | E04F 21/185 |

* cited by examiner

*Primary Examiner* — Andrew J Triggs
(74) *Attorney, Agent, or Firm* — FisherBroyles LLP; Ian R. Walsworth

(57) ABSTRACT

The present disclosure involves a device for inserting through adjoining panes of glass, which may be oriented to apply pressure to opposing sides of the glass in one orientation. The device generally comprises a shaft that accepts a fastener, which may be moved to tighten or loosen pressure applied by the device upon the glass. In one embodiment, the device comprises one or more plates for insertion through and placement against opposite sides of the adjoining panes of glass, and which can be used to reduce or remove bowing along the surface of the glass prior to sealing.

18 Claims, 5 Drawing Sheets

ENHANCED GLAZING DEVICE, ASSEMBLY AND METHOD FOR OPERATING THE SAME

CROSS-REFERENCE TO RELATED APPLICATIONS

The present application claims priority to and the benefit under 35 U.S.C. § 119(e) to U.S. Provisional Patent Application No. 62/865,040 filed on Jun. 21, 2019, the entire contents of which are incorporated by reference herein.

FIELD OF THE INVENTION

The present disclosure relates generally to the installation of glass in commercial buildings, homes, apartments and the like, and more specifically to devices used by glazers for installing glass, including glass partition walls. Methods for fabricating and using the foregoing devices are also disclosed herein.

COPYRIGHT NOTICE

A portion of this disclosure is subject to copyright protection. Limited permission is granted to facsimile reproduction of the patent document or patent disclosure as it appears in the U.S. Patent and Trademark Office (USPTO) patent file or records. The copyright owner reserves all other copyright rights whatsoever.

BACKGROUND OF THE INVENTION

Glazing relates to techniques used to install glass partitions, typically as part of a wall or window in a building. Separate sections or panes of glass are often used in such installations and arranged in series such that each separate pane of glass abuts another pane of glass, or is mounted to another surface, such as a sash, stile or rabbet. The adjoining panes of glass are frequently bowed, creating difficulties during installation, particularly when aligning larger panes of glass such as "window wall" partitions.

Given these difficulties, it is challenging to properly and efficiently align and secure one or more glass sections, especially prior to sealing each section to the abutting section. Installers often use makeshift devices in the past to address these difficulties. For instance, it is common to see glass temporarily held in place by shims connected on each side of a glass partition by several windings of electrical wire. This solution, however, is time consuming and requires the installer to operate from both sides of the glass partition. The use of temporary devices also requires an installer to locate and fabricate, in ad-hoc fashion, the shim/wire assembly, further delaying the installation process. Occasionally these temporary solutions will become loose or even break, causing further delays.

Other devices used by installers impair the application of silicon or other sealing material between the separate panes of glass and impair the visibility of the installer. Further, these devices provide little or no ability to gauge correction of bowing or accuracy in alignment of separate panes of glass. The temporary device, once made, cannot be reused or applied to different thickness of glass, as the windings must be completely undone before the device can be removed. Due to the time and resources required for these prior art devices, the installer often uses only a single shim/wire assembly along a single joint in the glass, further amplifying the problems described above. Thus, the problems and shortcomings are even more noticeable when utilizing such ad-hoc devices to temporarily secure panes of glass prior to sealing. It is with respect to the above issues and other problems presently faced by those of skill in the pertinent art that the embodiments presented herein were contemplated.

Accordingly, there is a need for a more adaptable and repeatable device that decreases the mean time for installing multiple panes of glass in a partition, enhances correction of defects in the glass, such as bowing, and which otherwise overcomes the disadvantages described above. The present disclosure also addresses different types of joints between abutting panes of glass, such that the objectives described herein can be realized regardless of the type of joint in a particular installation. There is also need for an improved method of adjoining separate panes of glass through use of such a device, which can be quickly inserted through a partition of glass without accessing the opposite side of the partition, and which can be quickly and efficiently secured by a single installer.

Other advantages over the prior art will become known upon review of the Summary, the Detailed Description and the appended claims.

SUMMARY OF THE INVENTION

According to various embodiments presented herein, the present disclosure describes a device used by glazers and other installers of glass in commercial buildings, homes, apartments, condominiums and the like that improves the ease of installation and alignment of various types and sizes of panes of glass, particularly glass partitions.

One particular aspect of the present disclosure involves a device for enhanced installation of glass, wherein the device has a first orientation for inserting through adjoining panes of glass, and wherein the device has a second orientation to apply pressure to opposing sides of the glass, and wherein the device may be easily tightened to stay in place during the installation process and in particular when oriented in the second orientation.

In another aspect, the device comprises a shaft that accepts at least one style of fastener, wherein the at least one fastener can be moved to tighten or loosen the pressure applied by the device upon the glass.

In yet another aspect, the device comprises at least a first and a second member or plate capable of insertion through and placement against opposite sides of one or more panes of glass. In embodiments, the device may be used to reduce or remove bowing along the surface of the panes of glass.

In yet another aspect, the present disclosure concerns an assembly for use with installation of two or more pieces of glass, comprising: a shaft comprising a longitudinal axis, a proximal end and a distal end; a first member located adjacent the distal end of the shaft; a second member having an opening for receiving the proximal end of the shaft and moveable along the longitudinal axis of the shaft; a fastener configured to be received by the shaft and moveable along the longitudinal axis of the shaft; the first member comprising a first contacting surface and a second contacting surface on opposite sides of the distal end of the shaft; and, the second member comprising a first contacting surface and a second contacting surface, both surfaces oriented in a direction opposite to the first and second contacting surfaces of the first member;

In yet another aspect, the assembly may be oriented in a first orientation to permit the first member to be placed through a seam or gap between the two or more pieces of glass.

In yet another aspect, the assembly may be oriented in a second orientation to permit the first and second contacting surfaces of the first member to be placed along a first side of the two or more pieces of glass, and further permit the first and second contacting surfaces of the second member to be placed along a second side of the two or more pieces of glass opposite of the first side.

In yet another aspect, the fastener is received by the shaft and adjusted to apply pressure to the second member.

In yet another aspect, a device for enhanced installation and alignment of multiple panes of glass may be made of various materials so as not to damage the glass, while securing the position of the glass in a proper alignment for sealing the adjoining sections together.

It is to be expressly understood that the ensuing description provides embodiments only, and is not intended to limit the scope, applicability, or configuration of the claimed invention. Rather, the ensuing description will provide those skilled in the art with an enabling description for implementing the embodiments. It should be understood that various changes may be made in the function and arrangement of elements without departing from the spirit and scope of the appended claims.

Unless otherwise indicated, all numbers expressing quantities, dimensions, conditions, and so forth used in the specification and claims are to be understood as being approximations which may be modified in all instances as required for a particular application of the novel apparatus described herein.

The phrases "at least one," "one or more," and "and/or," as used herein, are open-ended expressions that are both conjunctive and disjunctive in operation. For example, each of the expressions "at least one of A, B and C," "at least one of A, B, or C," "one or more of A, B, and C," "one or more of A, B, or C," and "A, B, and/or C" means A alone, B alone, C alone, A and B together, A and C together, B and C together, or A, B and C together.

The term "a" or "an" entity, as used herein, refers to one or more of that entity. As such, the terms "a" (or "an"), "one or more" and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C., Section 112(f). Accordingly, a claim incorporating the term "means" shall cover all structures, materials, or acts set forth herein, and all of the equivalents thereof. Further, the structures, materials, or acts and the equivalents thereof shall include all those described in the Summary, Brief Description of the Drawings, Detailed Description and Abstract.

The Summary is neither intended, nor should it be construed, as being representative of the full extent and scope of the present disclosure. Moreover, references made herein to "the present disclosure" and "the present invention" or aspects thereof should be understood to mean certain embodiments of the present disclosure, and should not necessarily be construed as limiting all embodiments to a particular description.

The present disclosure is set forth in various levels of detail in the Summary as well as in the attached drawings and the Detailed Description, and no limitation as to the scope of the present disclosure is intended by either the inclusion or non-inclusion of elements or components when describing certain embodiments herein. Additional aspects of the present disclosure will become more readily apparent from the Detailed Description, particularly when taken together with the drawings.

The above-described benefits, embodiments, and/or characterizations are not necessarily complete or exhaustive, and in particular, as to the patentable subject matter disclosed herein. Other benefits, embodiments, and/or characterizations of the present disclosure are possible utilizing, alone or in combination, as set forth above and/or described in the accompanying figures and/or in the description herein below.

BRIEF DESCRIPTION OF THE DRAWINGS

The accompanying drawings, which are incorporated herein and constitute a part of the specification, illustrate embodiments of the disclosure, and together with the Summary and the Detailed Description serve to explain the principles of these embodiments. In certain instances, details that are not necessary for an understanding of the disclosure or that render other details difficult to perceive may have been omitted. It should be understood, of course, that the present disclosure is not necessarily limited to the particular embodiments illustrated herein. Additionally, it should be understood that the drawings are not necessarily to scale. In the drawings.

Similar components and/or features may have the same reference number. Components of the same type may be distinguished by a letter following the reference number. If only the reference number is used, the description is applicable to any one of the similar components having the same reference number.

DETAILED DESCRIPTION

The present disclosure has significant benefits across a broad spectrum of endeavors. It is the Applicant's intent that this specification and the claims appended hereto be accorded a breadth in keeping with the scope and spirit of the disclosure and various embodiments disclosed, despite what might appear to be limiting language imposed by specific examples disclosed in the specifications.

To acquaint persons skilled in the pertinent arts most closely related to the present disclosure, preferred and/or exemplary embodiments are described in detail without attempting to describe all of the various forms and modifications in which the novel apparatus, devices, systems and methods might be embodied. As such, the embodiments described herein are illustrative, and as will become apparent to those skilled in the arts, may be modified in numerous ways within the spirit of the disclosure.

By way of providing additional background, context, and to further satisfy the written description requirements of 35 U.S.C. § 112, the following are incorporated by reference in their entireties for the express purpose of explaining and further describing the various tools and other apparatus commonly associated with installation of glass: U.S. Pat. Nos. 4,197,605, 4,571,170, 5,018,956 and 9,243,443.

Figure 1A:
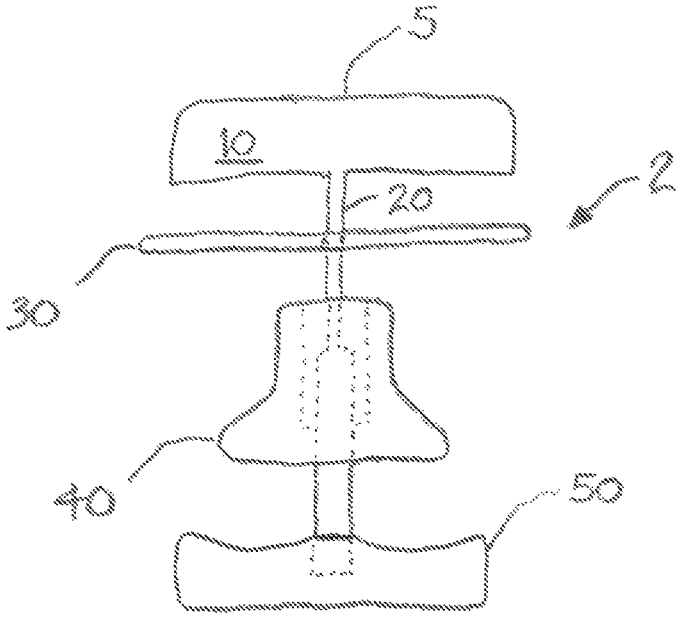
FIG. 1A shows a top plan view of an apparatus for use in glazing according to one embodiment of the present disclosure.

Referring to FIGS. 1A-4, varying embodiments of the present disclosure are shown. In the embodiment of FIG. 1A, a device, apparatus or assembly 2 for use in glazing is illustrated in a top plan view. The dashed lines in FIG. 1A are to illustrate internal and non-visible surfaces of the device 2 when in an assembled state as shown. The device 2 preferably comprises at least two distinct orientations. First, the device 2 may be oriented in a first orientation, also referred to as a deployable orientation, such that a distal portion 5 of the device 2 is oriented vertically to permit at least a portion of the device 2 to be placed through a seam or gap between two pieces or panes of glass G. The at least a portion of the device 2 configured to pass through the seam or gap may comprise a first member or plate 10, which may be substantially in the form shown in FIG. 1A. This plate 10 is preferably coupled to a shaft 20 that connects the plate 10 to the remainder of the device 2 in an assembled state. The shaft 20 may be threaded, partially threaded or other, and may be rotated to rotate the distal plate 10 after passing the plate 10 through the seam between the adjoining panes of glass G, as shown in FIG. 1B. The first member or plate 10 is preferably secured to the shaft 20 in a fixed relationship, may be welded or securely fixed to the shaft 20 by other means.

The device 2 preferably comprises a second member or plate 30 that is configured to receive the shaft 20 and move longitudinally along the shaft 20 to accommodate different thicknesses of glass G and adjust the location of the second plate 30 relative to the first plate 10. The device also preferably comprises a handle 50 and a fastener 40, described in greater detail below.

Figure 1B:
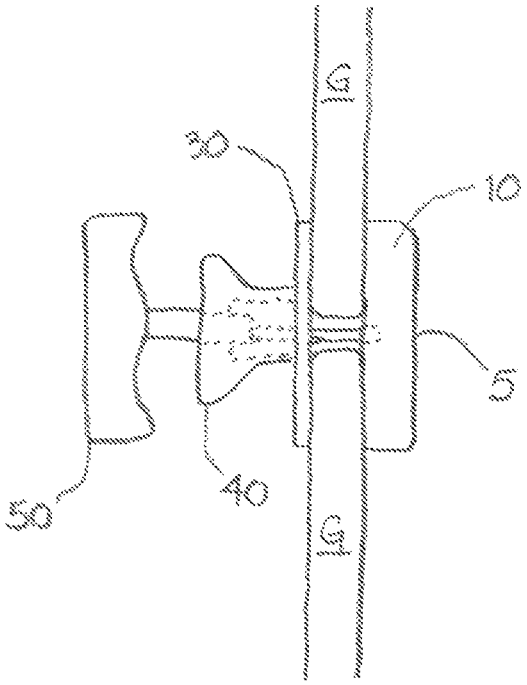
FIG. 1B shows another top plan view of the apparatus illustrated in FIG. 1A.

The device 2 preferably comprises a second orientation as shown in FIG. 1B, wherein the plate 10 has been rotated to a generally horizontal orientation such that the plate 10 may be leveraged against the distal surfaces of the panes of glass G. The shaft 20 is preferably sized so it may remain between the two panes of glass G and at least a portion of the shaft 20 may rotate freely without interference or damage to the edges of the panes of glass G. Once positioned in orientation, the proximal portion of the device (located on the proximal side of the panes of glass G) preferably comprise a second member 30, such as a plate, which may be positioned against the opposite side of the glass G as the first member 10 of the device 2. Once the distal and proximal first 10 and second members 30 or plates are positioned against the glass G, a fastener 40, such as a wingnut or equivalent, may be attached to and translate along the shaft 20 to compress the distal and proximal plates 10, 30 against the opposing surfaces of the glass G and secure the connection therebetween.

In embodiments, the plates 10, 30 may be moved, rotated, or adjusted freely prior to tightening the fastener 40. For example, prior to moving the plates 10, 30 to the second orientation, the device 2 may be slid vertically along the seam or gap between the panes of glass G until a desired location is achieved. The first member or plate 10 may be rotated after insertion through a gap or slot in two pieces of glass G, and the second member 30 may be rotated relative to the shaft 20 or translated along the length of the shaft 20 to accommodate different thicknesses of glass G. Multiple devices 2 may be inserted and similarly placed in the desired location, prior to orienting in the second orientation and securing with the fastener 40.

The plates 10, 30 may comprise padding, finished or buffered surfaces to ensure that the surfaces of the glass G are not damaged when the device 2 is in contact therewith. In a preferred embodiment, each plate 10, 30 comprises a first and second contacting surface on opposite sides of the shaft 20 for applying pressure along the glass G on opposite sides of the glass G, as shown in FIG. 1B. Rubber, silicon, vinyl or other material may be affixed to the contacting surfaces of the plates.

To add further stability and improved handling, the outer surfaces of the device 2 may further comprise texturing or other surface features, such as an over-molding material to improve grip (such as on the handle 50) when handling the device 2. In one embodiment, the surface features may be made of the same material and may be permanently attached to the device 2. In another embodiment, the surface features may be comprised of an overlay, and/or may be made of a different material, such as the ones described herein, and may further be selectively inserted onto the device 2 as desired.

The device 2 may be comprised of various materials, including but not limited to steel, stainless steel, titanium alloy, aluminum alloy, chromium alloy, and other metals or metal alloys. These materials may also include, for example, carbon fiber, ABS plastic, polyurethane, polyethylene, photo-polymers, resins, fiber-encased resinous materials, rubber, latex, synthetic rubber, synthetic materials, polymers, and natural materials.

Fabrication of the device may be achieved through molding, injection molding, rotational molding, 3D printing, including through use of a rapid prototyping machine, a 3D printing machine, or a stereolithography (STL) machine, or may be achieved by selective laser sintering (SLS), fused deposition modeling (FDM), direct metal laser sintering (DMLS), electron beam melting (EBM), or other manufacturing techniques.

Figure 1C:
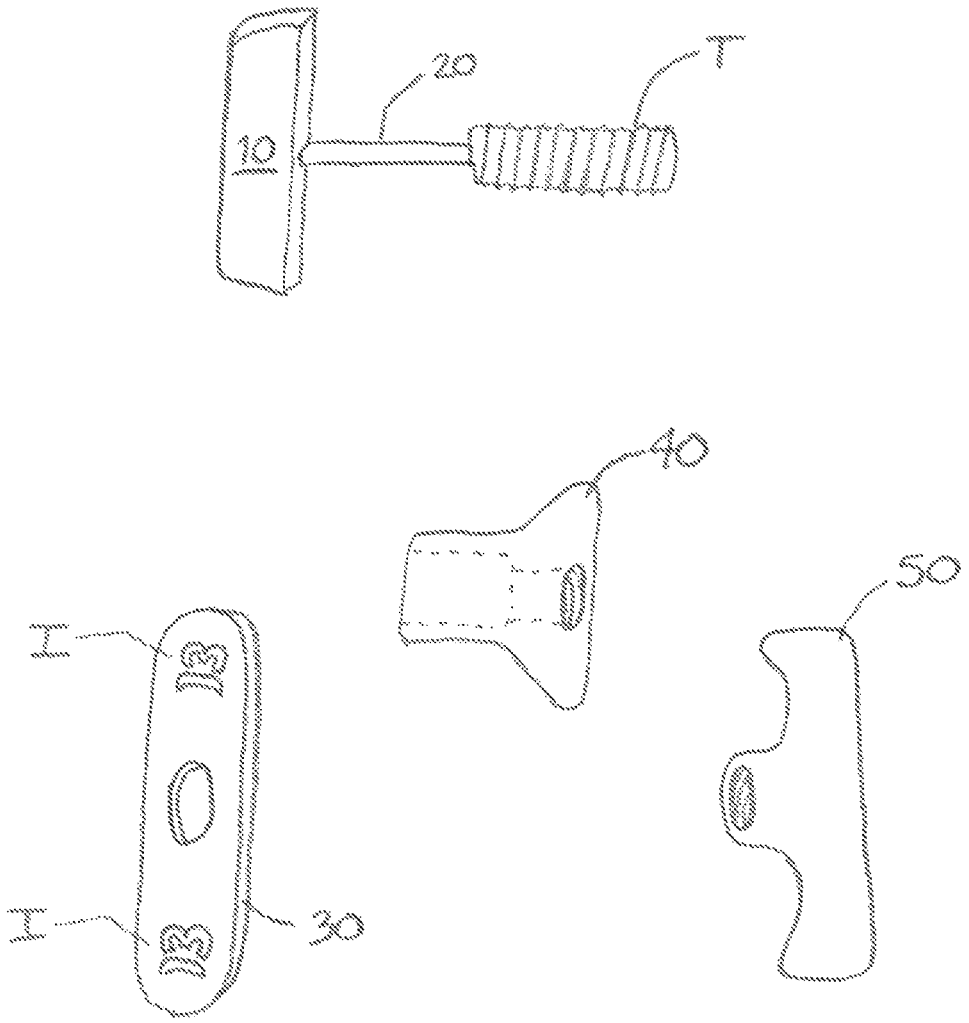
FIG. 1C shows an exploded view of components of the apparatus illustrated in FIG. 1A.

An exploded view of the components described herein is shown in FIG. 1C. In preferred embodiments, the first and second members 10, 30 may approximately ⅛ inch in thickness so as to easily pass through the majority of seams or gaps between two pieces of glass G. The shaft 20 of the device 2 is similarly dimensioned to permit such passage, and may be longer than depicted to accommodate thicker panes of glass than shown in FIG. 1B including, by way of example and not limitation, double pane glass. The shaft 20 may be solid or may be substantially hollow. The shaft 20 may have threading T on only a portion of the shaft 20, rather than the complete shaft 20. It is to be expressly understood that the device 2 and its component parts may be larger or smaller than depicted and described in FIGS. 1A-1C.

Various method steps for applying the device 2 described herein are also disclosed. As described above, the first member 10 is preferably fixed in relation to the shaft 20, while the second member 30 is adjustable in relation to the shaft 20, such that the second member 30 may be moved along the shaft 20 and form a larger or smaller distance between the first 10 and second members 30. In one step, the second member 30 is preferably adjusted until the gap between the first member 10 and second member 30 is sufficient to both insert and manipulate the device 2 between two pieces of glass (i.e., the distance between the first 10 and second members 30 is greater than the thickness of the pieces of glass G to permit free rotation without interference once the first member 10 is inserted through a gap in the glass G). In another step, the assembly is partially inserted through a gap or slot between the two pieces of glass G, such that the first member 10 is oriented lengthwise along the seam or gap and moved through the seam or gap, so that it is on the opposite side of the glass G from the second member 30. In a further step, the assembly is rotated such that the long axis of the first member 10 is no longer parallel to the gap or slot between the pieces of glass G, and one or more surfaces of the first member 10 may be placed against the glass G. In yet another step, the second member 30 is adjusted relative to the shaft 20 so that at least one distal surface of the second member 30 is placed against the glass G on the near side of the glass G (i.e., opposite from the surface of the glass the first member 10 is in contact with, as shown in FIG. 1B). In another step, the fastener 40 is tightened along the shaft 20 to apply pressure to the second member 30 and may continue to be tightened so that the pieces of glass G are in the desired plane, and preferably parallel to one another to avoid bowing or undesired bending. In another step, the glazer may proceed with caulking, sealing and otherwise finishing the installation of the pieces of glass G, including while the device 2 is in place. In one embodiment, another device 2 is applied to the pieces of glass G and the steps repeated prior to caulking or sealing, which may be particularly beneficial when installing large pieces of glass. The method may further comprise the step of removing the devices 2 and reapplying caulking or sealant to the areas between the pieces of glass where the device previously resided. These steps generally provide the sequence of events, although in certain methods the steps may vary in order from that described above.

One having skill in the art will appreciate that embodiments of the present disclosure may have various sizes. The sizes of the various elements of embodiments of the present disclosure may be sized to accommodate a particular size or thickness of glass, or a certain seam or gap between adjacent panes of glass, for example.

Figure 2A:
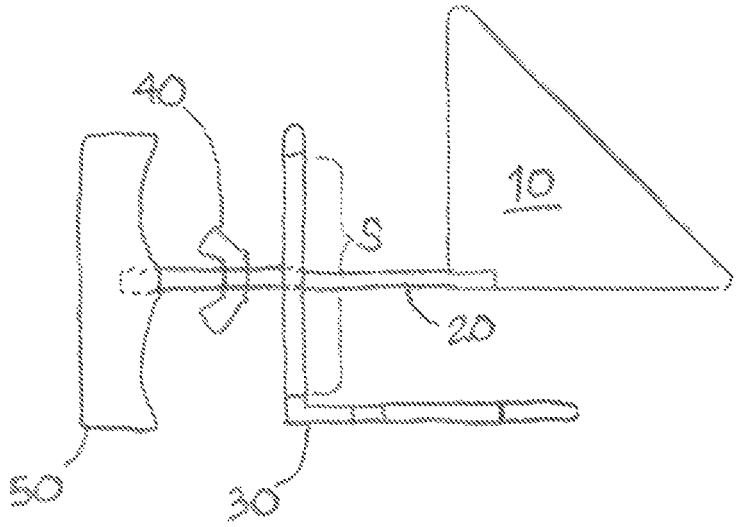
FIG. 2A shows a top plan view of an apparatus for use in glazing according to another embodiment of the present disclosure.
Figure 2B:
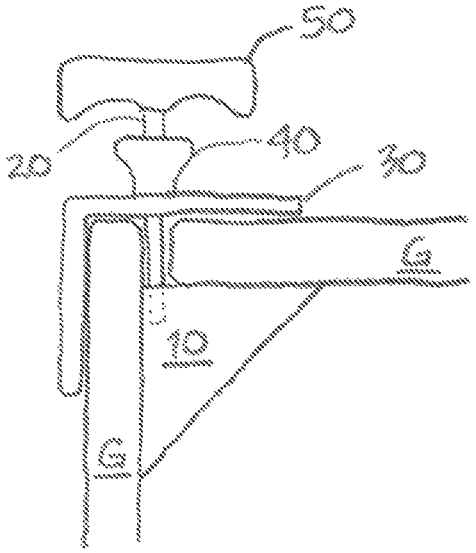
FIG. 2B shows another top plan view of the apparatus illustrated in FIG. 2A.

Referring now to FIGS. 2A-2B, the device 2 may accommodate panes of glass that are not aligned parallel to each other, such as two pieces of glass G oriented in a corner arrangement. The device 2 of this embodiment preferably comprises a first member 10 that is generally "wedge" shaped to accommodate such an alignment, yet still may be passed through a seam or gap between two adjacent panes of glass G. The wedge-shaped member 10 may be approximately 2 inches (in the x and y directions), although may be longer or shorter. The second member 30 is also shaped to contact the opposite surfaces of the glass as the first member 10, and once the fastener 40 is tightened, apply pressure to the glass on both sides of the glass extending from the seam or corner.

In embodiments, the device 2 shown in FIGS. 2A-2B may be utilized for enhanced glazing in a corner or perpendicular arrangement. The second member 30 preferably comprises one or more slots S that may receive the shaft of the assembly, and permit the shaft 20 to translate both longitudinally and laterally along the second member 30, which permits the device 2 to be adjusted for different thicknesses of glass G at the intersection of the two or more pieces of glass G (i.e., the corner). In embodiments, the first member 10 is approximately ⅛ inch thick, and the contacting surfaces are approximately 2 inches in length. The second member 30 is preferably sized according to the dimensions of the first member 10 to apply equivalent pressure to the opposing surfaces of the pieces of glass G.

The first and second members 10, 30 may be configured relative to one another to apply pressure to both panes of glass G forming the corner of a partition, for example. More particularly, FIG. 2A shows the device 2 of this embodiment in a first orientation, prior to insertion through the seam. FIG. 2B shows the device 2 in a second orientation or finished view, after the device 2 has been inserted through the seam and tightened against the opposing surfaces of the glass G. The first member 10 is preferably fixed to the distal portion of the shaft 20, whereas the second member 30 is preferably adjustable relative to the shaft 20. For example, the second member 30 may more along the shaft 20 (both longitudinally along the shaft 20 and laterally by moving the shaft 20 relative to the slot S in the second member 30) to adjust the position of the second member 30 when using the device 2 with different thicknesses of glass G. In this manner, a single device 2 may be provided to accommodate several different sizes of glass G or partitions.

Figure 3A:
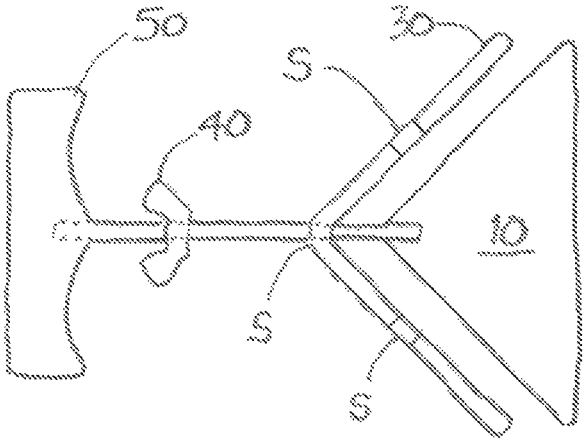
FIG. 3A shows a top plan view of an apparatus for use in glazing according to another embodiment of the present disclosure.
Figure 3B:
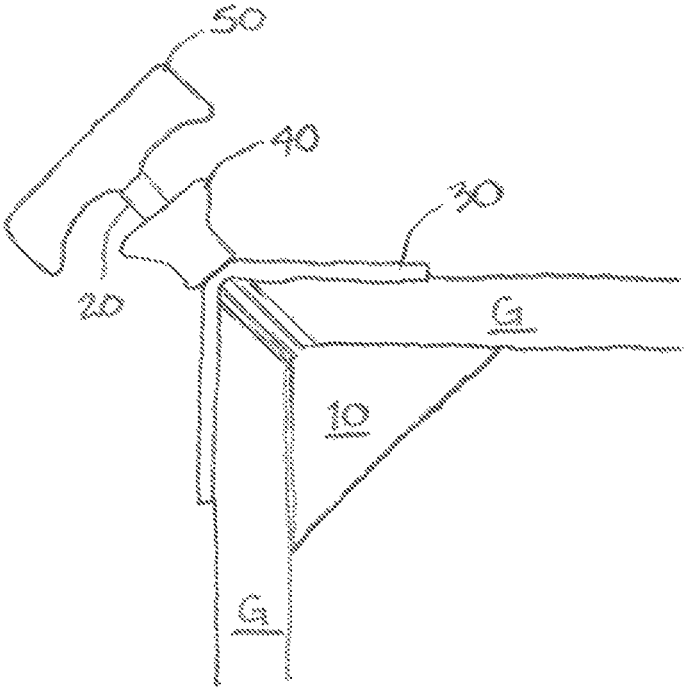
FIG. 3B shows another top plan view of the apparatus illustrated in FIG. 3A.

The present disclosure also relates to a device 2 used for adjoining two sections of mitered glass, as depicted in FIGS. 3A-3B. This device 2 comprises similar components as the device described above, but has a shaft 20 that is connected to the distal or first member 10 in a different arrangement to accommodate the placement of the distal portion relative to the adjoining panes of glass G. As shown in FIG. 3A, the shaft 20 is preferably inserted through a hole, channel or slot S in the second member at an oblique angle, such that the shaft 20 extends from the corner of the generally "L" shaped second member 30. This facilitates adjustment of the first member 10 and second member 30 relative to the shaft 20 as described above for use with different thicknesses of glass G. The fastener 40 shown may be the same or equivalent to the fastener described above in relation to FIGS. 1A-2B. In preferred embodiments, the first member 10 has a thickness of approximately ⅛ inch for insertion through the gap or slot between two pieces of glass G and achieve the second orientation shown in FIG. 3B. In even more preferred embodiments, the thickness is slightly less than ⅛ inch to ensure the joint or seam between the pieces of glass G is no greater than ⅛ inch. As shown in FIG. 3B, the fastener 40 may be tightened along the shaft 20 to apply pressure to the first member 10 and second member 20 once the device 2 is in the desired location, and thereby brace the pieces of glass G for caulking or sealing along the mitered seam between the pieces of glass G.

Figure 4:
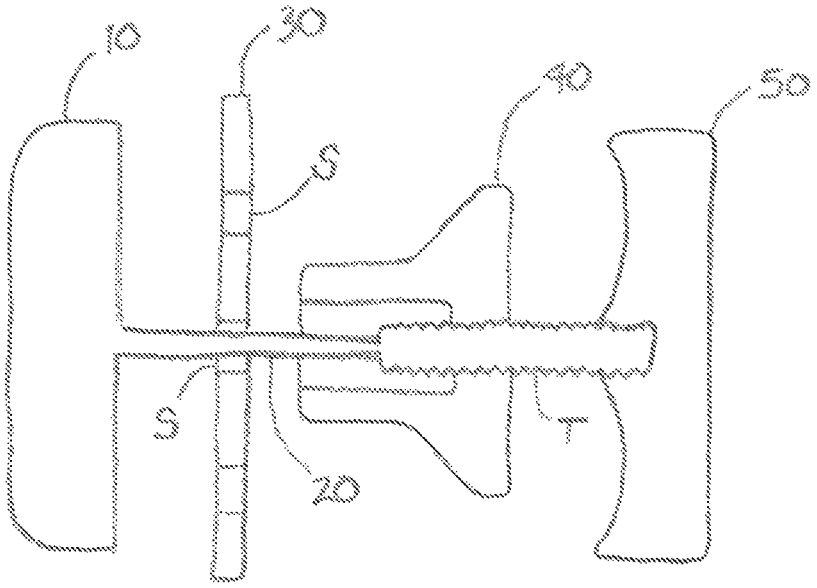
FIG. 4 shows a sectional view of an apparatus for use in glazing according to yet another embodiment of the present disclosure.

Additional aspects of the device 2 are shown in the sectional view of FIG. 4. Variations to the preferred embodiments illustrated in the drawing figures are contemplated. For example, in certain embodiments the shaft 2 may be completely threaded and accept different types of fasteners, including fasteners that are shaped to facilitate tightening by a user's fingers. In one of these embodiments, the shaft 2 may comprise ribs or equivalent features to allow a proximal or second plate 30 to pass over the shaft and become secured, at least temporarily, until the fastener is attached. In this manner, the connection between the fastener 40 and the shaft 20 of the assembly may be similar to a zip tie connection, a slip-ring connection, or similar means of attaching a shaft to a plate. In other embodiments, the assembly may comprise one or more washers or gaskets, or both, to facilitate the objectives described above.

The second member or plate 30 may be square, rectangular or other shape desirable to apply pressure to the proximal surfaces of the pieces of glass G. The fastener 40 may comprise a fin, indent, or similar structure along its outer surface for clarifying the orientation so that a person may easily determine the rotational orientation of the distal plate 10, even if the plate 10 is not visible (i.e., if the glass is heavily tinted or has been covered with a protective sheet during installation).

In other embodiments, indicia I may be provided along the surface of the first plate 10 or second plate 30 or the fastener 40, which inform the installer of the orientation of the assembly, the size of the components associated with the assembly, or to prevent overtightening of the fastener 40 relative to the shaft 20. In embodiments, the assembly may further comprise a washer or disc to distribute the force of the fastener 40 more evenly across the surface of the second member or plate.

The device 2 may comprise additional features, such as a contoured handle. The handle may be aligned vertically in a first position and then horizontally in a second position, which correlates to the rotation of the distal plate. In this embodiment, a wingnut, ribbed, or other style of fastener may be used. The contour of the handle may be provided to match the user's fingers, and further permit easy retraction of the handle and the shaft once the device is no longer needed to secure the position of the adjoining panes of glass. The handle may be removeable. In embodiments, the handle is permanently attached to the shaft and prevents the fastener from becoming removed from the shaft and inadvertently misplaced.

While various embodiments of the present disclosure have been described in detail, it is apparent that modifications and alterations of those embodiments will occur to those skilled in the art. However, it is to be expressly understood that such modifications and alterations are within the scope and spirit of the present disclosure, as set forth in the following claims. For further illustration, the information and materials supplied with the provisional patent applications from which this application claims priority are expressly made a part of this disclosure and incorporated by reference herein in their entirety.

It is expressly understood that where the term "glass" has been used to describe the various embodiments of the disclosure, the term should not be construed as limiting in any way. For instance, the device described herein may be used with other materials, and the methods described herein apply equally to adjoining portions of non-glass partitions, paneling, walls, flooring, ceiling panels, lighting enclosures, screens, skylights, solar panels/fabric, soffit, or other construction materials. Thus, the concepts herein may be applied to other types of procedures without departing from the spirit of the present disclosure.

The foregoing discussion of the disclosure has been presented for purposes of illustration and description. The foregoing is not intended to limit the disclosure to the form or forms disclosed herein. In the foregoing Detailed Description for example, various features of the disclosure are grouped together in one or more embodiments for the purpose of streamlining the disclosure. This method of disclosure is not to be interpreted as reflecting an intention that the claimed disclosure requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the disclosure.

The present inventions, in various embodiments, include components, methods, processes, systems and/or apparatuses substantially as depicted and described herein, including various embodiments, subcombinations, and subsets thereof. Those of skill in the art will understand how to make and use the present inventions after understanding the present disclosure. The present inventions, in various embodiments, include providing devices, components, steps and/or processes in the absence of items not depicted and/or described herein or in various embodiments hereof, including in the absence of such items as may have been used in previous devices or processes, e.g., for improving performance, achieving ease and\or reducing cost of implementation.

Moreover, though the present disclosure has included description of one or more embodiments and certain variations and modifications, other variations and modifications are within the scope of the disclosure, e.g., as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. An assembly for use with installation of two or more pieces of glass, comprising:

a shaft comprising a longitudinal axis, a proximal end and a distal end;

a first member located adjacent the distal end of the shaft and affixed to the shaft;

a second member having an opening for receiving the proximal end of the shaft and moveable along the longitudinal axis of the shaft;

a fastener configured to be received by the shaft and moveable along the longitudinal axis of the shaft;

the first member comprising a first contacting surface and a second contacting surface;

the second member comprising a first contacting surface and a second contacting surface, both surfaces oriented in a direction opposite to the first and second contacting surfaces of the first member;

wherein the assembly is configured to be oriented in at least two positions including a first orientation permitting the first member to be placed perpendicularly through a seam or gap along the face of the two or more pieces of glass;

wherein the assembly may be oriented in a second orientation permitting the first member, once placed through the seam or gap along the face of the two or more pieces of glass, to be rotated such that the first and second contacting surfaces of the first member are placed along a first, distal side of the two or more pieces of glass, and further permitting the first and second contacting surfaces of the second member to be placed along a second, proximal side of the two or more pieces of glass opposite of the first side; and wherein, once the assembly is in the second orientation, the fastener is received by the shaft and adjusted longitudinally along the shaft to apply pressure to the second member.

2. The assembly of claim 1 wherein the shaft comprises at least a partially threaded portion and the fastener has a threaded portion configured to receive the at least a partially threaded portion of the shaft.

3. The assembly of claim 1, wherein the first member has a thickness equal to or less than ⅛ inch to facilitate placement through the seam or gap along the face of the two or more pieces of glass.

4. The assembly of claim 1, wherein the first member is fixed to the distal portion of the shaft.

5. The assembly of claim 1 further comprising a layer of material along the first and second contacting surfaces of the first member.

6. The assembly of claim 1 further comprising a layer of material along the first and second contacting surface of the second member.

7. The assembly of claim 6, wherein the layer of material is selected from the group consisting of a rubber material, a latex material, a rubber latex material, a synthetic material, a polyurethane, a polyethylene, a photo-polymer, a polymer, an ABS plastic, a cloth material, a carbon fiber, a silicon-based material, a vinyl material and a natural material.

8. The assembly of claim 1 wherein the fastener is selected from the group consisting of a nut, a wingnut, a threaded closure, a non-threaded closure, a locknut, a snap-fit nut and a spring clip.

9. The assembly of claim 1 further comprising a washer placed along the shaft between the fastener and the second member.

10. The assembly of claim 1, wherein the first member and second member are comprised of a material selected from the group consisting of a steel, a stainless steel, a titanium alloy, an aluminum alloy, a chromium alloy, a metal alloys, a carbon fiber, an ABS plastic, a polyurethane, a polyethylene, a photo-polymer, a resin, a fiber-encased resinous material, a synthetic material, a polymer, and a natural material.

11. The assembly of claim 1 further comprising a handle on the proximal end of the shaft opposite the first member.

12. The assembly of claim 11, wherein the handle comprises at least one ergonomic shaped surface on a portion of the handle facing the first member.

13. The assembly of claim 11, wherein the handle is selectively removeable.

14. The assembly of claim 1 further comprising indicia on one or more of the shaft, the first member, the second member, and the fastener to indicate location or orientation of one or more of the shaft, the first member, the second member and the fastener.

15. The assembly of claim 1 further comprising indicia on one or more of the shaft or the fastener to prevent over-tightening of the fastener relative to the shaft.

16. The assembly of claim 1, wherein the two or more pieces of glass are abutting but not touching, thereby forming a gap between the two or more pieces of glass.

17. The assembly of claim 16, wherein the two or more pieces of glass have mitered surfaces along the gap between the two or more pieces of glass.

18. The assembly of claim 16, wherein the assembly is configured to receive caulking or sealant around the shaft of the assembly and within the gap between the two or more pieces of glass.

* * * * *